US005793247A

United States Patent [19]

McClure

[11] Patent Number: 5,793,247

[45] Date of Patent: Aug. 11, 1998

[54] CONSTANT CURRENT SOURCE WITH REDUCED SENSITIVITY TO SUPPLY VOLTAGE AND PROCESS VARIATION

[75] Inventor: David C. McClure, Carrollton, Tex.

[73] Assignee: SGS-Thomson Microelectronics, Inc., Carrollton, Tex.

[21] Appl. No.: 667,481

[22] Filed: Jun. 24, 1996

Related U.S. Application Data

[63] Continuation of Ser. No. 399,079, Mar. 8, 1995, abandoned, which is a continuation-in-part of Ser. No. 357,664, Dec. 16, 1994, Pat. No. 5,568,084, and Ser. No. 359,927, Dec. 20, 1994, Pat. No. 5,581,209.

[51] Int. Cl.[6] ..... G05F 1/10

[52] U.S. Cl. ..... 327/538; 327/530; 327/543

[58] Field of Search ..... 323/312, 315; 327/108, 165, 166, 184, 374, 376, 377, 380, 381, 530, 538, 543, 66; 331/57

[56] References Cited

U.S. PATENT DOCUMENTS

| | | | |
|---|---|---|---|
| 3,714,543 | 1/1973 | Sahara et al. | 323/315 |
| 4,064,506 | 12/1977 | Cartwright, Jr. | 340/347 DA |
| 4,325,019 | 4/1982 | Tezuka | 323/315 |
| 4,546,327 | 10/1985 | Suzuki et al. | 330/253 |
| 4,608,530 | 8/1986 | Bacrania | 323/315 |
| 4,723,108 | 2/1988 | Murphy et al. | 323/315 |
| 4,864,162 | 9/1989 | Maoz | 327/308 |
| 4,877,978 | 10/1989 | Platt | 307/473 |
| 4,999,567 | 3/1991 | Morigami | 323/315 |
| 5,045,806 | 9/1991 | Yan | 330/252 |
| 5,047,706 | 9/1991 | Ishibashi et al. | 323/313 |
| 5,162,668 | 11/1992 | Chen et al. | 307/296.8 |
| 5,276,356 | 1/1994 | Shirotori | 327/108 |
| 5,291,071 | 3/1994 | Allen et al. | 327/108 |
| 5,300,837 | 4/1994 | Fischer | 327/538 |
| 5,363,059 | 11/1994 | Thiel | 330/253 |
| 5,373,226 | 12/1994 | Kimura | 323/313 |
| 5,396,110 | 3/1995 | Houston | 327/172 |
| 5,450,030 | 9/1995 | Shin et al. | 327/525 |
| 5,451,898 | 9/1995 | Johnson | 327/538 |

FOREIGN PATENT DOCUMENTS

| | | | |
|---|---|---|---|
| A 0427 557 | 5/1991 | European Pat. Off. | H03F 1/52 |
| A 0 454 170 | 10/1991 | European Pat. Off. | G05F 1/46 |
| A 0 482 869 | 4/1992 | European Pat. Off. | H03K 19/003 |
| A 43 36 883 | 5/1994 | Germany | H03K 5/12 |
| A 2 214 333 | 8/1989 | United Kingdom | G05F 3/26 |

OTHER PUBLICATIONS

IBM Technical Disclosure Bulletin, vol. 32, No. 10a, Apr. 1990, pp. 26–28, XP000083250 "On-Chip Voltage Regulators with Improved Ripple Rejection".

1993 IEEE International Symposium on Circuits and Systems, vol. 2, 3–6 May 1993, pp. 1318–1321, XP000379220, Hoi-Jun Yoo et al. "A Precision CMOS Voltage Reference with Enhanced Stability for the Application to Advanced ALSI's".

*Primary Examiner*—Timothy P. Callahan
*Assistant Examiner*—Jeffrey Zweizig
*Attorney, Agent, or Firm*—Theodore E. Galanthay; Lisa K. Jorgenson; Christopher F. Regan

[57] ABSTRACT

A current source for generating a current that is relatively stable over variations in the power supply voltage and temperature, and over variations in process parameters is disclosed. The current source includes a bias circuit, for producing a compensating bias voltage, and a current mirror. The bias circuit utilizes a voltage divider to generate a divided voltage based on the power supply value. The divided voltage is applied to the gate of a modulating transistor (biased in saturation) in a first current mirror, which controls a current applied to a linear load device. The voltage across the load device determines the bias voltage, which is in turn applied to the gate of a transistor in the reference leg of a second current mirror. The bias voltage controls the current in the reference leg of the second current mirror, and an output leg mirrors the second reference current to produce a stable output current.

26 Claims, 2 Drawing Sheets

FIG. 3
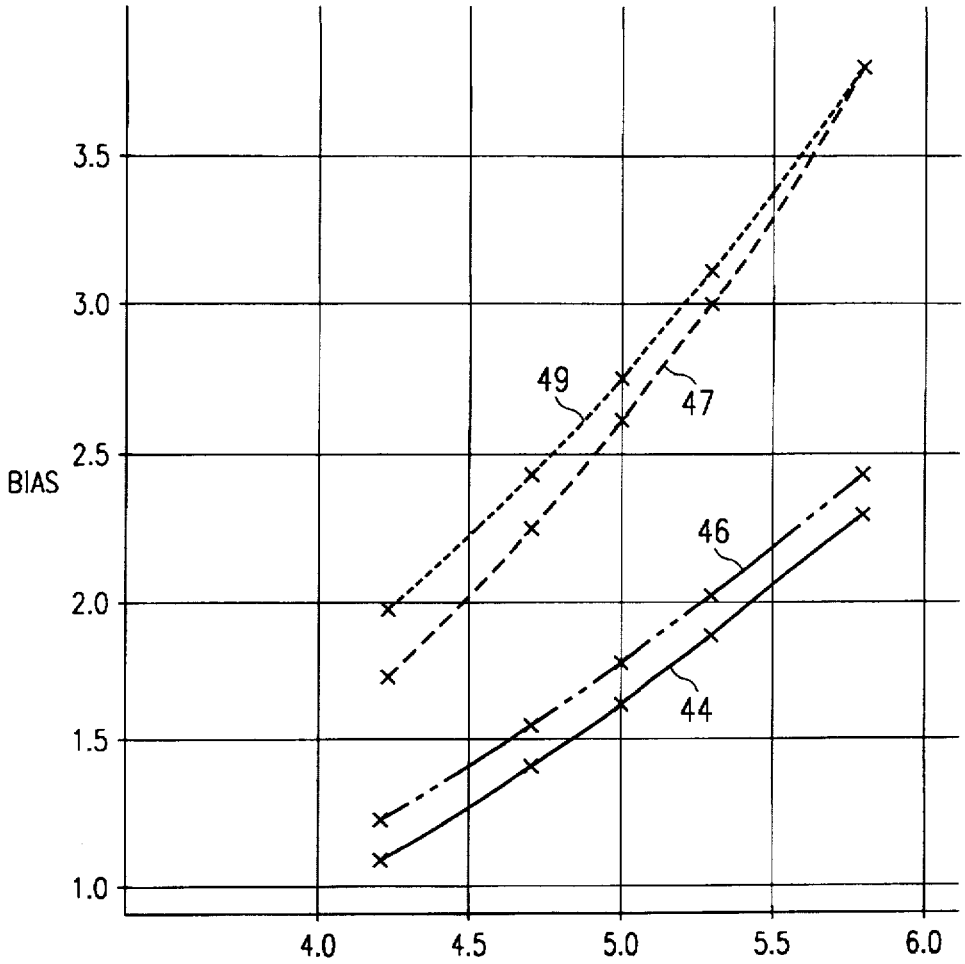
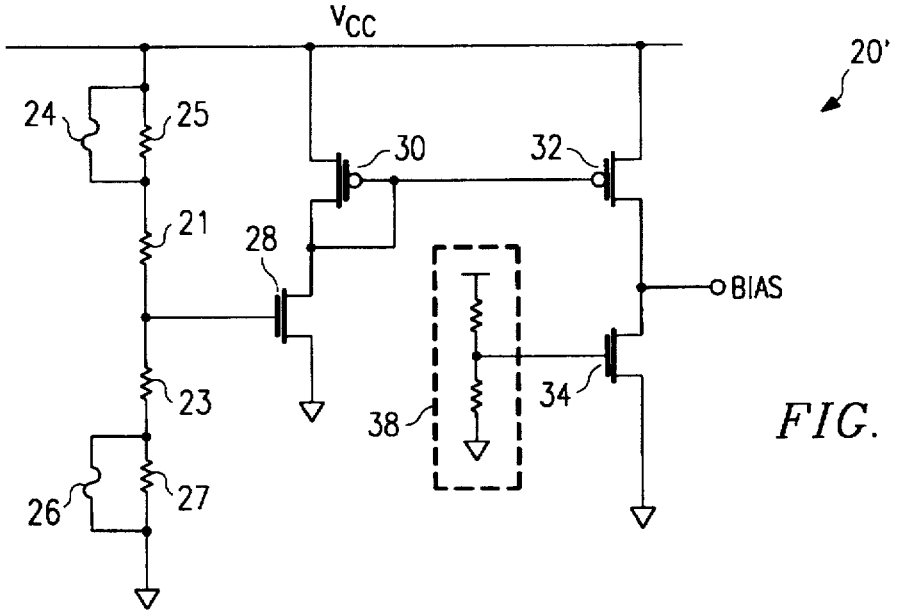
FIG. 4

CONSTANT CURRENT SOURCE WITH REDUCED SENSITIVITY TO SUPPLY VOLTAGE AND PROCESS VARIATION

This application is a continuation of application Ser. No. 08/399,079, filed Mar. 8, 1995 and now abandoned, which is a continuation-in-part of application Ser. No. 08/357,664, U.S. Pat. No. 5,568,084 (Attorney's Docket No. 94-C-114), filed Dec. 16, 1994, U.S. Pat. No. 5,568,084 and application Ser. No. 08/359,927, U.S. Pat. No. 5,581,209 (Attorney's Docket No. 94-C-124), filed Dec. 20, 1994, both of which are assigned to SGS-Thomson Microelectronics, Inc., and both of which are incorporated hereinto by reference. This application is also related to applications Ser. No. 08/360,228 (Attorney's Docket No. 94-C-116), Ser. No. 08/360,229 (Attorney's Docket No. 94-C-121), Ser. No. 08/359,397 (Attorney's Docket No. 94-C-123), Ser. No. 08/359,926 (Attorney's Docket No. 94-C-125), and Ser. No. 08/360,227 (Attorney's Docket No. 94-C-126), all also filed Dec. 20, 1994, and assigned to SGS-Thomson Microelectronics, Inc.

This invention is in the field of integrated circuits, and is more particularly directed to current source circuits useful therein.

BACKGROUND OF THE INVENTION

In modern digital integrated circuits, particularly those fabricated according to the well-known complementary metal-oxide-semiconductor (CMOS) technology, many functional circuits internal to an integrated circuit rely upon current sources that conduct a stable current. Examples of such functional circuits include voltage regulators, differential amplifiers, sense amplifiers, current mirrors, operational amplifiers, level shift circuits, and reference voltage circuits. Such current sources are generally implemented by way of field effect transistors, with a reference voltage applied to the gate of the field effect transistor.

As is known in the art, the integrated circuits utilizing such current sources would operate optimally if the current provided by the current source were to be stable over variations in operating and process conditions. However, as is well known in the art, the drive characteristics of MOS transistors can vary quite widely with these operating and process variations. Conventional MOS transistor current sources will generally source more current at low operating temperature (e.g., 0° C.), high $V_{cc}$ power supply voltage (e.g., 5.3 volts for a nominal 5 volt power supply), and process conditions that maximize drive (e.g., shorter than nominal channel length); conversely, these current sources will source less current at high operating temperature (e.g., 100° C.), low $V_{cc}$ power supply voltage (e.g., 4.7 volts for a nominal 5 volt power supply), and process conditions that minimize drive current (e.g., longer than nominal channel length). The ratio between the maximum current drive and minimum current drive for such conventional current sources has been observed to be on the order of 2.5 to 6.0. The behavior of circuits that rely on these current sources will therefore tend to vary greatly over these operating and process conditions, requiring the circuit designer to design for a greater operating margin, thus reducing the maximum performance of the integrated circuit.

Variations in the current provided by a current source are especially troublesome where the current to be sourced is relatively large. For example, output driver circuitry for conventional integrated circuits may require currents of up to as much as 20 ma to be sourced by a current source. In such an application, variations of this current of greater than a factor of two cannot be tolerated.

It is therefore an object of the present invention to provide a current source that provides a substantially constant current over variations in operating parameters and manufacturing process conditions.

It is another object to provide such a current source that may be utilized in output driver circuitry, where substantially large currents are required.

Other objects and advantages of the present invention will be apparent to those of ordinary skill in the art having reference to the following specification together with its drawings.

SUMMARY OF THE INVENTION

The invention may be implemented into an integrated circuit as a current source, having a current mirror output stage, controlled by a bias voltage from a bias circuit that tracks variations in process parameters and power supply voltage. The bias circuit is based on a resistor voltage divider that sets the current in the input leg of a current mirror in the bias circuit; in this input leg, a modulating transistor that is maintained in saturation, which in turn dictates the current through a linear load device in the output leg of the bias circuit current mirror, generating the bias voltage applied to the current mirror output stage. The current mirror output stage has a reference leg that includes a p-channel transistor having its gate receiving the bias voltage from the bias circuit, in series with an n-channel transistor having its gate tied to its drain. The relative sizes of the p-channel and n-channel transistors in this reference leg are selected to maintain the p-channel transistor in saturation. The output leg of the current mirror output stage is an n-channel transistor having its gate connected to the gate and drain of the n-channel transistor in the reference leg. The current sourced in the output leg of the current mirror is thus quite stable over variations in the power supply voltage, temperature, and manufacturing process conditions.

BRIEF DESCRIPTION OF THE DRAWINGS

FIG. 3 is a plot of bias voltage BIAS versus $V_{cc}$ power supply voltage for various process conditions and temperatures, as generated by the bias circuit shown in FIG. 2.

FIG. 4 is an electrical diagram, in schematic form, of the current source according to an alternative embodiment of the invention.

DETAILED DESCRIPTION OF THE PREFERRED EMBODIMENT

Figure 1:
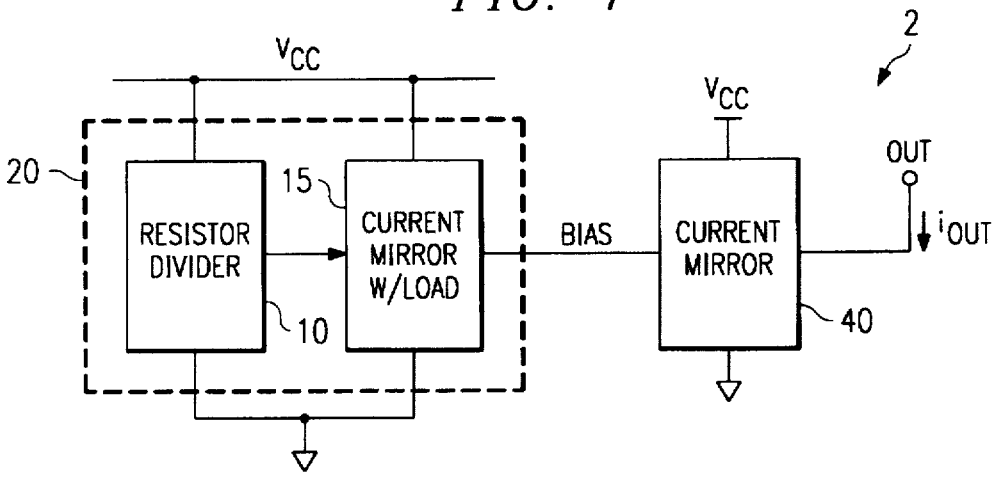
FIG. 1 is an electrical diagram, in block form, of a current source according to the preferred embodiment of the invention.

Referring to FIG. 1, the construction of current source 2 according to the preferred embodiment of the present invention will now be described. Current source 2 according to this embodiment of the invention includes bias circuit 20 for generating a bias voltage on line BIAS. As illustrated in FIG. 1, bias circuit 20 includes resistor divider 10 which produces a voltage that is a desired fraction of the voltage of the $V_{cc}$ power supply. This divided voltage is applied to a current mirror 15. As will be described in further detail hereinbelow, current mirror 15 generates a current that is applied to a load, so that the output of current mirror 15 is a bias voltage on line BIAS. The voltage on line BIAS is applied to a current mirror 40, which sinks a fixed output current $i_{OUT}$ at terminal OUT, operating as a current source.

Figure 2:
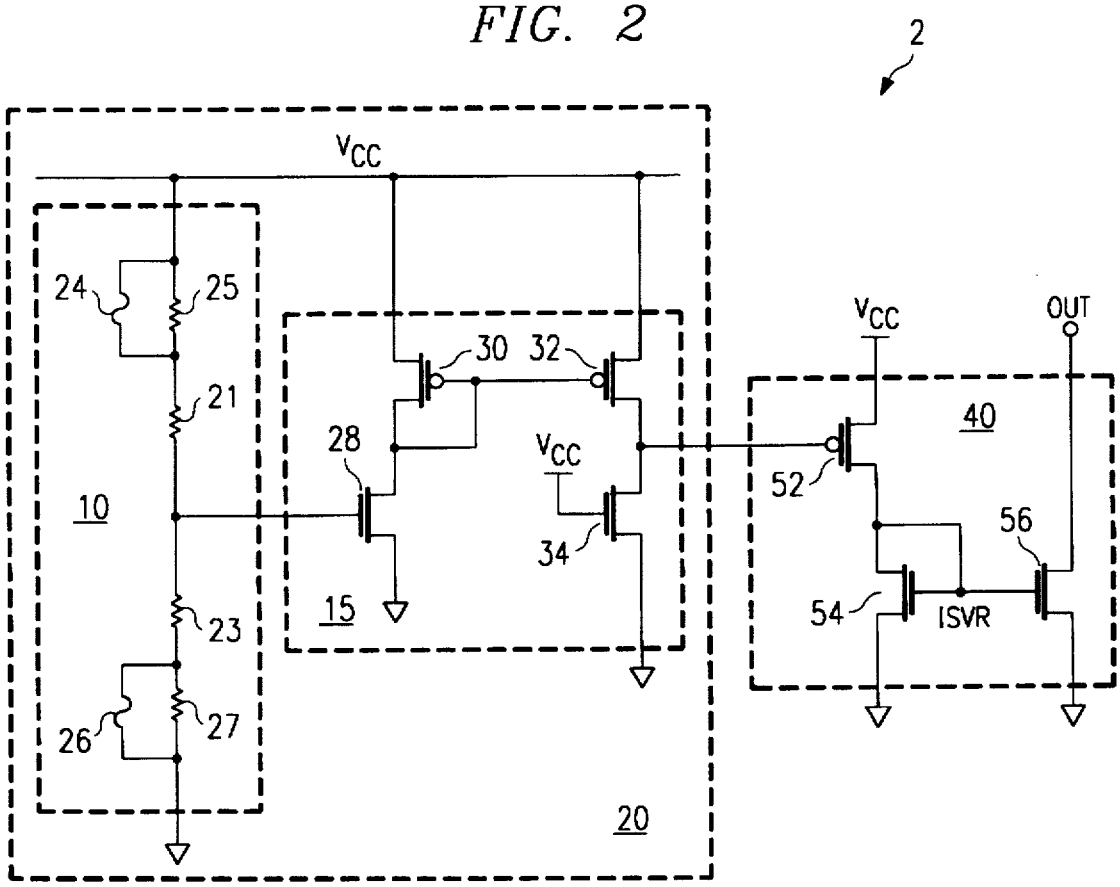
FIG. 2 is an electrical diagram, in schematic form, of the current source according to the preferred embodiment of the invention.

Referring now to FIG. 2, the construction and operation of bias circuit 20 and current mirror 40 in current source 2 according to the preferred embodiment of the invention will now be described in detail. In general, bias circuit 20 is a current mirror bias circuit, in which the reference leg of a current mirror 15 is controlled by a voltage divider 10. As will be evident from the description hereinbelow, bias circuit 20 provides a bias voltage on line BIAS that varies in a consistent manner with variations in the value of power supply voltage $V_{cc}$ and with variations in certain manufacturing process parameters.

In this example, bias circuit 20 provides a voltage on line BIAS to the gate of p-channel transistor 52 in current mirror 40. It is desired in this example that the gate-to-source voltage of p-channel transistor 52 remain substantially constant over variations in the voltage of the $V_{cc}$ power supply, so that the current therethrough remains constant; in other words, it is desired that the voltage on line BIAS follow variations in $V_{cc}$. In this way, current $i_{OUT}$ produced at terminal OUT by current mirror 40 will remain substantially constant over such variations.

In this embodiment of the invention, bias circuit 20 includes resistor divider 10 having resistors 21, 23 connected in series between the $V_{cc}$ power supply and ground. The output of resistor divider 10, at the node between resistors 21, 23, is presented to the gate of an n-channel transistor 28 in current mirror 15. Resistors 21, 23 are preferably implemented as polysilicon resistors, in the usual manner. As shown in FIG. 2, additional resistors 25, 27 may also be present in each leg of the voltage divider, with fuses 24, 26 connected in parallel therewith. In this way, the integrated circuit into which bias circuit 20 is implemented is fuse-programmable to allow adjustment of the voltage applied to the gate of transistor 28, if desired. Indeed, it is contemplated that multiple ones of additional resistors 25, 27 and accompanying fuses may be implemented in the voltage divider, to allow a wide range of adjustment of the voltage output of the voltage divider.

As indicated above, the gate of transistor 28 receives the output of the voltage divider of resistors 21, 23. The source of transistor 28 is biased to ground, and the drain of transistor 28 is connected to the drain and gate of p-channel transistor 30, which in turn has its source tied to $V_{cc}$. The combination of transistors 28, 30 is a reference leg of a current mirror, with the current conducted therethrough substantially controlled by the voltage output of resistor divider 10 of resistors 21, 23. Accordingly, the voltage applied to the gate of transistor 28, and thus the current conducted by transistors 28, 30 in the reference leg of the current mirror, will vary with variations in the voltage of the $V_{cc}$ power supply so as to remain at approximately the same fraction of the voltage of the $V_{cc}$ power supply.

The output leg of current mirror 15 in bias circuit 20 includes p-channel mirror transistor 32 and linear load device 34. P-channel transistor 32 has its source connected to $V_{cc}$ and its gate connected to the gate and drain of transistor 30, in current mirror fashion. The drain of transistor 32 is connected to the linear load device 34, at line BIAS. Load device 34 may be implemented as an n-channel transistor 34, having its source at ground and its gate at $V_{cc}$, in which case the common drain node of transistors 32, 34 drives the bias voltage output on line BIAS. Alternatively, linear load device 34 may be implemented as a precision resistor, or as a two-terminal diode.

In any case, linear load device 34 is important in providing compensation for variations in process parameters, such as channel length. Variations in the channel length of transistors 30, 32 will cause variations in the current conducted by transistor 32 and thus, due to the linear nature of load device 34, will cause a corresponding variation in the voltage on line BIAS. Accordingly, bias circuit 20 provides an output voltage on line BIAS that tracks variations in process parameters affecting current conduction by transistors in the integrated circuit.

As noted above, the current conducted by transistor 32 is controlled to match, or to be a specified multiple of, the current conducted through transistor 30. Since the current conducted through transistors 28, 30 is controlled according to the divided-down voltage of the $V_{cc}$ power supply, the current conducted by transistor 32 (and thus the voltage on line BIAS) is therefore controlled by the $V_{cc}$ power supply. The voltage on line BIAS will thus also track modulation in the $V_{cc}$ power supply voltage, as will be described in further detail hereinbelow, by way of modulation in the voltage drop across linear load 34.

Certain sizing relationships among the transistors in bias circuit 20 are believed to be quite important in ensuring proper compensation. Firstly, transistor 28 is preferably near, but not at, the minimum channel length and channel width for the manufacturing process used. By transistor 28 having a channel length near the process minimum, the current conducted by transistor 28 will vary with variations in the channel length for the highest performance transistors in the integrated circuit; use of a longer channel length would reduce the sensitivity of transistor 28 to such variations. However, the channel length of transistor 28 should be slightly larger than minimum, to avoid hot electron effects and short channel effects. Transistor 28 also preferably has a relatively small, but not minimum, channel width, to minimize the current conducted therethrough, especially considering that bias circuit 20 will conduct DC current at all times through transistors 28, 30 (and mirror leg transistor 32 and linear load 34). An example of the size of transistor 28 according to a modern manufacturing process would be a channel length of 0.8 μm and a channel width of 4.0 μm, where the process minimums would be 0.6 μm and 1.0 μm, respectively.

P-channel transistors 30, 32 must also be properly sized in order to properly bias transistor 28 and linear load device 34 (when implemented as a transistor), respectively. For proper compensation of the bias voltage on line BIAS, transistor 28 is preferably biased in the saturation (square law) region, while transistor 34 is biased in the linear (or triode) region. This allows transistor 34 to act effectively as a linear resistive load device, while transistor 28 remains saturated. As is evident from the construction of bias circuit 20 in FIG. 2, such biasing depends upon the relative sizes of transistor 28 and 30, and the relative sizes of transistors 32 and 34.

It is preferable for transistor 30 to be as large as practicable so that the voltage at the gate of transistor 28 may be as near to $V_{cc}$ as possible while maintaining transistor 28 in saturation. This is because variations in $V_{cc}$ will be applied to the gate of transistor 28 in the ratio defined by the voltage divider of resistors 21, 23; accordingly, it is preferable that this ratio be as close to unity as possible, while still maintaining transistor 28 in saturation. A large W/L ratio for transistor 30 allows its drain-to-source voltage to be relatively small, thus pulling the drain voltage of transistor 28 higher, which allows the voltage at the gate of transistor 28 to be higher while still maintaining transistor 28 in saturation. The tracking ability of bias circuit 20 is thus improved by transistor 30 being quite large.

In the above example, where the $V_{cc}$ power supply voltage is nominally 5.0 volts, the following table indicates the preferred channel widths (in microns) of transistors 28, 30, 32 and 34 in the arrangement of FIG. 2, for the case where the channel length of each is 0.8 μm:

TABLE

| Transistor | Channel Width (μm) |
|---|---|
| 28 | 4.0 |
| 30 | 32.0 |
| 32 | 76.0 |
| 34 | 4.0 |

It has been observed (through simulation) that this example of bias circuit 20 is effective in maintaining good tracking of the voltage on line BIAS over a relatively wide range of $V_{cc}$ supply voltage. FIG. 3 is a plot of the voltage on line BIAS as a function of $V_{cc}$, simulated for maximum and minimum transistor channel lengths in a 0.8 micron manufacturing process, illustrating the operation of bias circuit 20 according to the present invention. Curves 44, 46 in FIG. 3 correspond to the low-current process corner (i.e., maximum channel length) at 0° and 100° C. junction temperatures, respectively; curves 47, 49 in FIG. 3 correspond to the high-current process corner (i.e., minimum channel length) at 0° and 100° C. junction temperatures, respectively. As is evident from FIG. 3, tracking of increasing $V_{cc}$ by the voltage on line BIAS is quite accurate, even over wide ranges in temperature and process parameters. As will be described in further detail hereinbelow, this tracking effect results in a substantially constant output current $i_{OUT}$ from the output of current mirror 40.

Referring back to FIG. 2, the construction of current mirror output circuit 40 will now be described in detail. Current mirror 40 in this example is implemented by way of p-channel transistor 52 having its source biased to $V_{cc}$ and its gate biased by bias voltage BIAS from the output of bias circuit 20 described hereinabove. N-channel transistor 54 is connected in diode fashion, with its gate and drain connected to the drain of transistor 64. The sizes of transistors 52 and 54 are selected to ensure that p-channel transistor 52 remains in saturation for the desired level of bias voltage BIAS. For example, for a bias voltage BIAS of approximately 2 volts, transistors 52 and 54 with W/L ratios of approximately 15 will maintain transistor 52 in saturation where $V_{cc}$ is nominally 5 volts.

The common node at the drains of transistors 52, 54 presents a reference voltage ISVR that is applied to the gate of n-channel transistor 56, which constitutes the output leg of current mirror 40. N-channel transistor 56 has its source biased to ground, and its drain connected to terminal OUT. Accordingly, the current conducted by transistor 56, namely output current $i_{OUT}$, is a mirrored current relative to the current conducted by transistor 54 in the reference leg of current mirror 40.

The relative sizes of transistors 54, 56 are selected so that the current sourced by transistor 56 is the desired multiple of that conducted by transistors 52, 54. For example, if the ratio is to be 1:1, the width/length ratios of transistors 54, 56 will be equal to one another; alternatively, if the current to be sourced by transistor 56 is to be a multiple of that conducted by transistors 52, 54, the W/L ratio of transistor 56 will be the desired multiple of that of transistor 54.

In operation, current source 2 according to this embodiment of the invention provides a relatively constant output current $i_{OUT}$ as a result of the tracking of variations in power supply voltage and process parameters by bias circuit 20 in its generation of the bias voltage on line BIAS, because the conditions causing shifts in the voltage on line BIAS similarly affect the drive characteristics of the transistors in current mirror 40. Specifically, both variations in the process conditions that shift the voltage on line BIAS (e.g., the shift between curves 46 and 49 in FIG. 3) and variations in the power supply voltage $V_{cc}$ affect the drive characteristics of transistor 52 in current mirror 40, with the net effect being that the current conducted by transistor 52 is substantially constant over these variations. For example, those process conditions resulting in curves 47, 49 of FIG. 3 cause transistor 52 to conduct more current for a given set of bias conditions. However, the increased voltage generated by bias circuit 20 on line BIAS under these conditions compensates for the additional current drive of p-channel transistor 52, by decreasing the gate-to-source voltage applied to transistor 52. Similarly, as the power supply voltage $V_{cc}$ increases, the voltage on line BIAS also increases, thus maintaining the gate-to-source voltage at p-channel transistor 52 substantially constant over variations in power supply voltage. With the current through transistor 52 remaining constant, the mirrored output current $i_{OUT}$ will tend to remain substantially constant over these variations.

As described in copending application Ser. No. 08/359,927, filed Dec. 20, 1994, and incorporated by reference hereinto, certain circuit applications require relatively large currents to be controlled by field-effect current sources. Especially in these applications, and when considering the possibility of large variations in process parameters and power supply voltages expected over temperature, it is desirable that output current $i_{OUT}$ be as stable as possible. The construction of the current source of FIGS. 1 and 2 according to this embodiment of the invention provides such stability. In the above example, simulation results indicate that the ratio of maximum to minimum current conducted by transistor 56 in current mirror 40, where bias circuit 20 set the voltage on line BIAS applied thereto, is approximately 1.17, taken over variations in temperature from 0° C. to 100° C., over variations in process parameters (i.e., transistor channel length, gate oxide thickness, and other known drive-varying parameters) resulting in drive current variations of about 50%, and over variations in the $V_{cc}$ power supply voltage from 4.7 volts to 5.3 volts. In this particular example, where the minimum current required to be conducted by transistor 56 in current mirror 40 is 20 ma, the maximum current sourced by transistor 56 will be approximately 23.4 ma.

It is contemplated that the current source of this embodiment of the invention may be useful in other circuit designs, as well. For example, circuits such as voltage regulators, differential amplifiers, sense amplifiers, current mirrors, operational amplifiers, level shift circuits, and reference voltage circuits all may be implemented to utilize a current source transistor (i.e., transistor 56). Control of the current source transistor in the manner described hereinabove, to ensure a relatively stable current to be sourced by transistor 56, is contemplated to be beneficial in these applications, as well.

As described above, and in copending application Ser. No. 08/357,664 filed Dec. 16, 1994 and incorporated herein by this reference, many variations to bias circuit 20 may be made while still benefiting from the present invention. One such variation is illustrated in FIG. 4, by way of bias circuit 20'. Similar elements in circuit 20' as those in circuit 20 described hereinabove will be referred to with the same reference numerals.

Bias circuit 20' is constructed similarly as bias circuit 20 described hereinabove. In this example, however, the gate of linear load transistor 34 is set by voltage divider 38, such that the gate voltage is a specified fraction of the $V_{cc}$ power supply voltage. Transistor 34, while operating substantially as a linear load, is in fact a voltage-controlled resistor, such that its on resistance is a function of the gate-to-source voltage. By applying only a fraction of $V_{cc}$ to the gate of transistor 34, as shown in FIG. 4, undesired reduction of the resistance of transistor 34 may be reduced in the event that $V_{cc}$ makes a positive transition.

Also as described in copending application Ser. No. 08/357,664 filed Dec. 16, 1994, incorporated herein by this reference, circuitry may be provided to selectively enable and disable the generation of the bias voltage BIAS, if such selectivity is useful in a particular application.

The present invention thus provides the important advantage of a current source that provides a stable output current over a wide range of temperature, power supply voltage, and manufacturing process parameters. According to the embodiments of the present invention described hereinabove, this stable output current is obtained from the generation of a bias voltage that tracks variations in process conditions and power supply voltages in a manner which compensates for the effects of these variations in the transistors of an output current mirror. The current source of the present is especially beneficial in applications where relatively large currents are required, such as in output driver circuitry, without risk that the maximum current of the current source is excessive.

While the invention has been described herein relative to its preferred embodiments, it is of course contemplated that modifications of, and alternatives to, these embodiments, such modifications and alternatives obtaining the advantages and benefits of this invention, will be apparent to those of ordinary skill in the art having reference to this specification and its drawings. It is contemplated that such modifications and alternatives are within the scope of this invention as subsequently claimed herein.

I claim:

1. A current source, comprising:

a resistor divider coupled between a supply voltage and a reference voltage for producing a divided voltage;

a first current mirror connected to said resistor divider and to the supply voltage, said first current mirror comprising a reference leg and an output leg, said reference leg comprising a first modulating field-effect transistor controlled by the divided voltage for generating a first reference current conducted by the reference leg and a first reference field-effect transistor connected to said first modulating field-effect transistor for maintaining said first modulating field-effect transistor in saturation, said first modulating field-effect transistor having a relatively small channel length which is near the process minimum so that the first reference current varies based upon process variation, and wherein the output leg comprises:

a mirror transistor for conducting a first mirrored current corresponding to the first reference current; and a load, for conducting the first mirrored current and for producing a varying bias voltage, which varies with supply voltage and with process variation, responsive to the first mirrored current; and a second current mirror connected to the supply voltage and comprising a reference leg and an output leg, said reference leg comprising a second modulating field-effect transistor connected to the supply voltage and having a gate connected to receive the varying bias voltage which varies with supply voltage and with process variation so that said output leg produces an output current mirroring the second reference current and with the output current having reduced variation despite variation of the supply voltage and process variation.

2. The current source of claim 1, wherein the first reference field-effect transistor has a drain connected to a mirror node, has a source connected to the power supply voltage, and has a gate connected to its drain; and wherein said first modulating field-effect input transistor has a conductive path connected between the mirror node and the reference voltage, and has a control terminal receiving the divided voltage.

3. The current source of claim 2, wherein the mirror transistor has a source/drain path connected between the power supply voltage and the bias output node, and has a control terminal connected to the mirror mode.

4. The current source of claim 3, wherein the load comprises:

a load transistor, having a conductive path connected between the bias output node and the reference voltage, and having a control terminal for receiving a voltage biasing the load transistor in the linear region.

5. The current source of claim 4, wherein the reference leg of the second current mirror comprises:

a second reference transistor, having a source/drain path, and having a gate receiving the bias voltage; and a third reference transistor having a source/drain path connected in series with the source/drain path of the second reference transistor between the power supply voltage and the reference voltage, and having a gate connected to its drain;

wherein the output leg of the second current mirror comprises an output transistor having a source/drain path, having a gate connected to the gate of the third reference transistor, and having a source biased to the same potential as the source of the third reference transistor.

6. The current source of claim 4, wherein the first reference field-effect transistor and the mirror transistor are p-channel field effect transistors; and wherein the first modulating field-effect transistor and the load transistor are n-channel field effect transistors.

7. The current source of claim 6, wherein the first reference field-effect transistor has a relatively large size so that the first modulating field-effect transistor is biased in the saturation region.

8. The current source of claim 7, wherein the size of the mirror transistor is selected so that the load transistor is biased in the linear region.

9. The current source of claim 4, wherein the voltage received at the control terminal of the load transistor is a fraction of the power supply voltage.

10. The current source of claim 1, wherein the load is a resistor.

11. The current source of claim 1, wherein the load is a diode.

12. The current source of claim 4, wherein the reference leg of the second current mirror comprises:

a second reference transistor, having a source/drain path, and having a gate receiving the bias voltage; and a third reference transistor having a source/drain path connected in series with the source/drain path of the second reference transistor between the power supply voltage and the reference voltage, and having a gate connected to its drain;

wherein the output leg of the second current mirror comprises an output transistor having a source/drain path, and having a gate connected to the gate of the third reference transistor, and having a source biased to the same potential as the source of the third reference transistor.

13. A method of generating a stable current, comprising the steps of:

applying a supply voltage to a voltage divider to produce a divided voltage;

applying the divided voltage to the control terminal of a first modulating field-effect transistor to control a first reference current in a reference leg of a first current mirror connected to the supply voltage, said first modulating field-effect transistor biased in the saturation region by a first reference field-effect transistor connected to said first modulating field-effect transistor, said first modulating field-effect transistor being formed to have a relatively small channel length which is near the process minimum so that the first reference current varies based upon process variation;

mirroring the first reference current to produce a first mirrored current in an output leg of the first current mirror;

applying the mirrored current to a load in the output leg of the first current mirror to produce a varying bias voltage which varies with supply voltage and with process variation responsive to the first mirrored current; and applying the varying bias voltage to the control terminal of a second reference field-effect transistor connected to the supplying voltage in a reference leg of a second current mirror to control a second reference current therein; and mirroring the second reference current to produce a second mirrored current having reduced variation despite variation of the supply voltage and process variation.

14. The method of claim 13, wherein the output leg of the first current mirror comprises a mirror transistor and wherein the load comprises a load transistor, each of said mirror and load transistors having a conduction path connected in series with one another, wherein the mirror transistor has a control terminal coupled to the reference leg of the first current mirror so that the current conducted by the mirror transistor mirrors that conducted by the first modulating field-effect transistor;

and further comprising the step of:

biasing the load transistor in the linear region.

15. The method of claim 13, wherein the reference leg of the second current mirror includes first and second reference transistors having source/drain paths connected in series, wherein the drain and gate of the second reference transistor are connected together;

and further comprising:

biasing the first reference transistor in saturation.

16. A current generator circuit, comprising:

first and second voltage dividers, each coupled between first and second supply voltages, and configured to produce first and second respective divided voltages;

a first modulating field-effect transistor, having a gate connected to receive said first divided voltage, and having source/drain diffusions of a first conductivity type, said first modulating field-effect transistor having a relatively small channel which is near the process minimum and being biased into saturation to generate a reference current which varies based upon process variation;

a first current mirror connected to be driven by said first modulating field-effect transistor at an input connection and connected to the first supply voltage to provide a current at an output connection which is proportional to the current at said input connection;

a second field-effect transistor, having a gate connected to receive said second divided voltage, and having source/drain diffusions of said first conductivity type connected to pass said current from said output connection of said first mirror to generate a varying bias voltage which varies with supply voltage and with process variation; and an additional field-effect transistor connected to the first supply voltage and having a gate connected to receive the varying bias voltage which varies with the first supply voltage and with process variation from said output connection of said first current mirror, and having source/drain diffusions of a second conductivity type.

17. The circuit of claim 16, wherein said first conductivity type is n.

18. The circuit of claim 16, wherein said first transistor has one of said source/drain diffusions thereof directly connected to said first power supply voltage, and said additional transistor has one of said source/drain diffusions thereof directly connected to said second power supply voltage.

19. The circuit of claim 16, wherein said first power supply voltage is a positive voltage, and said second power supply voltage is ground.

20. The circuit of claim 16, wherein each said voltage divider consists of a resistor ladder.

21. The circuit of claim 16, further comprising an additional current mirror operatively connected to be driven by a constant-current output from said additional field-effect transistor.

22. A method for generating a fixed current, comprising the steps of:

producing first and second divided voltages which are intermediate between first and second supply voltages;

receiving said first divided voltage on a gate of a first modulating field-effect transistor which is connected to drive an input connection of a current mirror and is connected to the first supply voltage, said first modulating field-effect transistor having a relatively small channel length which is near the process minimum and being biased into saturation to generate a reference current which varies based upon process variation, and mirroring the reference current from said input connection onto an output connection of said mirror;

passing said current at said output connection of said mirror through source/drain diffusions of a second field-effect transistor which has a gate connected to receive said second divided voltage; and controlling a gate of an additional field-effect transistor connected to the first supply voltage with a varying voltage from said output connection of said first current mirror, said first and second transistors both having source/drain diffusions of a first conductivity type, and said additional transistor having source/drain diffusions of a second conductivity type, said additional transistor accordingly providing a constant-current output.

23. The method of claim 22, wherein said first conductivity type is n.

24. The method of claim 22, wherein said first transistor has one of said source/drain diffusions thereof directly connected to said first power supply voltage, and said additional transistor has one of said source/drain diffusions thereof directly connected to said second power supply voltage.

25. The method of claim 22, wherein said first power supply voltage is a positive voltage, and said second power supply voltage is ground.

26. The method of claim 22, wherein said step of producing divided voltages is performed by two resistor ladders.

* * * * *